United States Patent [19]

Cavallaro

[11] Patent Number: 5,044,900

[45] Date of Patent: Sep. 3, 1991

[54] POSITIVE DISPLACEMENT SHUTTLE PUMP

[75] Inventor: William A. Cavallaro, Bradford, Mass.

[73] Assignee: Knight Tool Company, Inc., Haverhill, Mass.

[21] Appl. No.: 486,901

[22] Filed: Mar. 1, 1990

[51] Int. Cl.[5] ..... F04B 19/02

[52] U.S. Cl. ..... 417/466; 417/469; 222/383

[58] Field of Search ..... 417/466, 469, 498; 222/181, 378, 383

[56] References Cited

U.S. PATENT DOCUMENTS

| | | | |
|---|---|---|---|
| 1,184,779 | 5/1916 | Shaw | 417/466 |
| 1,252,875 | 1/1918 | Ashmusen | 417/466 |
| 1,699,236 | 1/1929 | Goldrick | 417/498 |
| 2,274,241 | 2/1942 | Lemanski | 417/466 |
| 2,410,517 | 11/1946 | Muller et al. | 417/469 |
| 3,586,129 | 6/1971 | Cass | 417/469 |
| 4,043,711 | 8/1977 | Seino | 417/469 |
| 4,646,969 | 3/1987 | Sorm et al. | 222/383 |

FOREIGN PATENT DOCUMENTS

| | | | |
|---|---|---|---|
| 114905 | 4/1918 | United Kingdom | 417/466 |

*Primary Examiner*—Leonard E. Smith
*Assistant Examiner*—Michael I. Kocharov
*Attorney, Agent, or Firm*—Iandiorio & Dingman

[57] ABSTRACT

A positive displacement shuttle pump having a cylinder with axially displaced and mutually isolated inlet and outlet portions; a shuttle piston having a reservoir for accepting pressurized feed from the inlet port in the feed cycle and for dispensing feed to the outlet port in the dispensing cycle; a displacement piston extending longitudinally in the shuttle piston and communicating with the reservoir; an actuator for extending the displacement piston into the reservoir to pressurize the feed and urge the feed through the outlet port during the dispensing cycle; the displacement piston is responsive to the pressurized feed in the reservoir for retracting during the feed cycle; the displacement piston driving the shuttle piston through the feed and dispensing cycles.

11 Claims, 2 Drawing Sheets

POSITIVE DISPLACEMENT SHUTTLE PUMP

FIELD OF INVENTION

This invention relates to a positive displacement shuttle pump for dispensing fluids, and more particularly to such a pump which uses the motion of the pump to automatically operate an internal metering piston to measure out and dispense the proper quantity of a fluid.

BACKGROUND OF INVENTION

Current fabrication techniques in the electronics industry require extremely precise, repeatable dispensing of very small amounts of adhesive or solder paste. For example, in surface mount technology drops of solder paste earlier applied to leads of 0.06 inch width and spacing of 0.100 mil now must be deposited to mount leads of 0.007 mil on spacings of 0.020 inch.

With such small, closely spaced leads a number of problems are aggravated. The amount of solder paste or adhesive deposited must be small and consistent in volume from lead to lead or the leads might be bent or encounter different attachment resistance. In addition, bridging can occur between the leads. Such attachment shortcomings are even more problematical when the surface mount chips which must be delicately removed, replaced and re-soldered have a value of up to $2000–3000. There are a number of pumps presently available for dispensing fluids but all have serious shortcomings.

Conventional syringe pumps, typically air pressure driven, operate (pulse) at high speeds, e.g., three times a second, which vibrates the paste and causes the solids to settle out and clog the pump. Further, the separation distorts the proper proportions of each of the elements—lead, tin, flux and solvent in the solder paste or constituents in other mixtures, so that an improper mixture of paste or adhesive is being deposited. Further, as the pumping action depletes the solder paste supply in the syringe, the empty space is filled by more and more air. Air is compressible; therefore, once the depletion begins there is no way to know just how much time and pressure should be applied on each stroke in order to keep the output volume consistent. Syringe pumps also are very difficult to control for small volumes. A typical syringe pump cylinder would have to move only microinches to dispense $10^{-6}$ cubic inches of material.

Systolic pumps squeeze the feed material. If the feed material is solder, then the flakes of tin and lead are pressed against the tube and their abrasive quality tends quickly to wear out the tube. Gear pumps suffer from the fact that the gear meshing action tends to squeeze the solder flakes or other feed material between the gear teeth. In the case of solder flakes, the lead or tin begins to coat the gear teeth. This eventually packs the teeth and jams the gears while removing lead and tin from the solder paste so that the paste dispensed does not contain its constituents in the proper proportions, and eventually jams the gears together.

In order to avoid this problem, gear teeth are typically designed with sufficient clearances so that the feed mixtures don't get crushed between the moving gear teeth. With these larger clearances the volumetric uncertainties are large with respect to the small volumes that these pumps are required to measure and dispense. In addition, the gear teeth characteristic dimensions must be larger than the clearances required. Thus with a reasonable tooth size, the amount of feed mixture dispensed requires only a small rotation of the gears, which is not easily controlled to give precise metering.

In conventional piston pumps, the feed pressure necessary to introduce the mixture to the pump can add unpredictable amounts to the volume being dispensed and the piston retraction can draw back the feed material, such as solder paste, from the nozzle, which further detracts from the predictability of the dispensing volume. It is necessary to vary the feed pressure in piston pumps to accommodate for differences in the viscosity of the feed material, but this introduces additional problems: increased pressure of the piston pump results in increased pressure tending to drive out the feed material, even when the piston is in the retracted position, so that leakage and inconsistency become even more of a problem.

SUMMARY OF INVENTION: I

It is therefore an object of this invention to provide a simple, compact and reliable positive displacement pump for metering a fluid.

It is a further object of this invention to provide such a pump which is extremely accurate in dispensing a fluid and consistent in its accuracy.

It is a further object of this invention to provide such a pump which eliminates unpredictable cross-feeding from the input to the output.

It is a further object of this invention to provide such a pump which eliminates drawback which sucks back fluid from the dispensing nozzle or port.

It is a further object of this invention to provide such a pump which requires no valves or complex controls.

It is a further object of this invention to provide such a pump which can operate at a high rate of speed.

It is a further object of this invention to provide such a pump which functions without causing settling or separation of the feed mixture.

It is a further object of this invention to provide such a pump which precisely delivers minute quantities of fluids with great repeatability.

It is a further object of this invention to provide such a pump which develops high pressure during the dispensing cycle, forcing liquid through very small nozzles.

It is a further object of this invention to provide such a pump which is small, lightweight and easy to operate.

It is a further object of this invention to provide such a pump which is easy to construct and has few moving parts.

It is a further object of this invention to provide such a pump which can be operated by any of a wide variety of actuators.

The invention results from the realization that a truly accurate, consistent pump for metering very small quantities of a fluid of various viscosities can be effected by using a shuttle piston to move a feed reservoir between the feed inlet and dispensing outlet and dispensing feed from that reservoir using a metering piston disposed in the shuttle piston and automatically actuated by the operation of the shuttle piston.

This invention features a positive displacement shuttle pump having a cylinder with axially displaced and mutually isolated inlet and outlet ports. The shuttle piston has a reservoir for accepting pressurized feed from the inlet port in the feed cycle and for dispensing feed to the outlet port in the dispensing cycle. A displacement piston extends longitudinally in the shuttle piston which communicates with the reservoir. An actuator extends the displacement piston into the reservoir to pressurize the feed and urge the feed through the outlet port during the dispensing cycle; the displacement piston is responsive to the pressurized feed in the reservoir for retracting during the feed cycle. There are means for driving the shuttle piston through the feed and dispensing cycles.

In a preferred embodiment, the cylinder and the shuttle piston are of circular cross section. The ports may be on opposite sides of the cylinder. The reservoir may include a cross bore in the shuttle piston. The displacement piston may be coaxial with the shuttle piston and circular in cross section. There may be stop means to limit the retraction of the displacement piston in the feed cycle. The reservoir may include a chamber proximate the displacement piston for exposing the displacement piston to feed pressure during the feed cycle to retract the displacement piston. The actuator may include adjustment means for setting the amount of feed dispensed by the displacement piston. The means for driving may include a connecting rod or simply a handle.

DISCLOSURE OF PREFERRED EMBODIMENT

Other objects, features and advantages will occur to those skilled in the art from the following description of a preferred embodiment and the accompanying drawings, in which.

Figure 1:
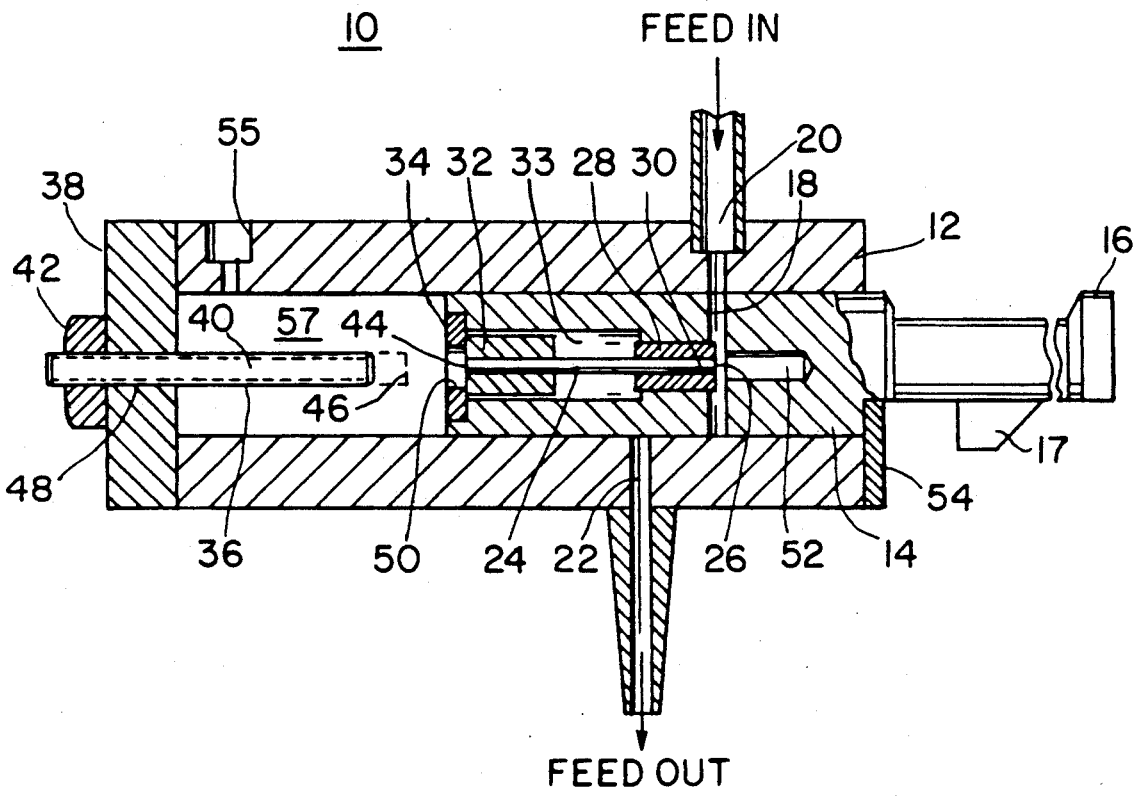
FIG. 1 is a cross-sectional diagram of a positive displacement shuttle pump in the feed cycle according to this invention.

The invention may be accomplished with a displacement shuttle pump which has a cylinder with axially displaced and mutually isolated inlet and outlet ports: that is, the ports in normal operation are totally unable to communicate with each other, thereby preventing any drawback or crossover of the feed which would cause leakage of unpredictable or unmeasurable volume. Slidably received in the cylinder is a shuttle piston which has a reservoir for accepting pressurized feed from the inlet port during the feed cycle and for dispensing feed to the outlet port during the dispensing cycle. Typically the cylinder and the piston may be circular in cross section, but not necessarily. The cylinder may be of any other suitable cross section. The shuttle piston may be driven to and from in the cylinder by any number of linear devices or rotary devices with a linear converter: for example, air or electrical solenoids, cranks, or the like. The reservoir may be a peripheral or annular chamber on the shuttle piston, or may be a cross bore through the shuttle piston. Whatever its shape, the reservoir aligns with the inlet port during the feed cycle to receive fresh feed, and then aligns with the outlet port during the dispensing cycle in order to dispense some precisely measured minute portion of feed. But the reservoir never communicates simultaneously with both: they are mutually isolated. Dispensing is accomplished by a displacement piston which acts to meter the amount of feed dispensed from the reservoir. The displacement piston extends longitudinally in the shuttle piston. The head of the displacement piston communicates with the reservoir and the displacement piston contains a stop element for limiting its retraction during the feed cycle.

There is an actuator for extending the displacement piston into the reservoir to pressurize the feed and urge the feed through the outlet port during the dispensing cycle, and the displacement piston is directly responsive to the pressurized feed in the reservoir for retracting during the feed cycle. In operation, when the shuttle piston is in the feed cycle, the pressure of the feed drives the displacement piston to retract up to the limit of its stop. When the shuttle piston reciprocates to its dispensing cycle, the dispensing piston encounters the stationary, passive, actuator, which accommodates the movement of the shuttle piston but prevents the further movement of the displacement piston, thereby actually causing relative motion between the shuttle piston and the displacement piston which it carries, so that the displacement piston protrudes at least partway through the reservoir, which has now been disconnected from the feed inlet. This intrusion of the displacement piston into the reservoir pressurizes the feed in the reservoir and causes it to be driven out of the outlet port which the reservoir encounters in the dispensing cycle. The inlet and outlet ports may be on opposite sides of the cylinder. If the cylinder is circular, the ports may be diametrically opposed, but they need not be. They could be side by side. They are mutually isolated by virtue of the fact that they are axially displaced and so the reservoir cannot align with both of them at the same time.

The reservoir may include an ancillary chamber proximate the displacement piston for exposing the displacement piston to feed pressure during the feed cycle and assisting in the retraction of the displacement piston. There is a recess proximate the head of the displacement piston, so that even when it is extended there is sufficient room above its head so that the feed pressure being introduced into the reservoir during the feed cycle can sufficiently access the head of the piston to drive it back and retract it. The actuator may include an adjustment device in order to control the position of the actuator and thereby control the extent of travel or intrusion of the displacement piston into the reservoir during the dispensing cycle.

There is shown in FIG. 1 a positive displacement shuttle pump 10 according to this invention which includes a housing cylinder 12 which may be circular in cross section and a shuttle piston 14 which will have the same cross section as cylinder housing 12. Shuttle piston 14 may be driven reciprocally to the left and right in FIG. 1 by means of a simple handle 16 that can be hand operated. There is a reservoir 18 in piston 14 which as shown in FIG. 1 constitutes a cross bore, but it may as well be a peripheral or annular space or a space of any other suitable configuration. In the feed cycle, as pictured in FIG. 1, reservoir 18 aligns with inlet port 20 which provides a means for introducing feed to reservoir 18 in the dispensing cycle. When piston 14 slid to the left, reservoir 18 aligns with outlet port 22 through which the feed is dispensed in repeatably precise, minute quantities. Metering or dispensing piston 24 is slidably reciprocally received in shuttle piston 14 and as shown is coaxially disposed with shuttle 14. The head 26 of piston 24 communicates with reservoir 18.

Piston 24 is slidably mounted in bearing 28 in bore 30 of piston 14. Piston 24 carries a stop element 32 which is slidably received in enlarged bore 33, and is fixed to piston 24. Stop element 32 engages with a limiting element 34 on shuttle piston 14 to limit the extent of retraction; that is, movement to the left in FIG. 1 of piston 24. There is an actuator member 36 mounted in the end plate 38 of cylinder 12. Actuator 36 includes rod 40 and a threaded knurled adjustment nut 42. When piston 14 is driven to the left in the dispensing cycle, the end 44 of metering piston 24 is brought into contact with the end 46 of rod 40. Since rod 40 is stationary by means of the threaded engagement as shown at 48 with end plate 38, the movement to the left of metering piston 24 is arrested while the movement to the left of shuttle piston 14 is permitted to continue because of the enlarged hole 50 in limit plate 34, which permits rod 40 to penetrate into shuttle piston 14. Thus as shuttle piston 14 continues to move to the left and the like movement of metering piston is halted, the metering piston begins to protrude into reservoir 18 to the extent allowed to by the adjustment controlled by nut 42. Port 55 is provided in cylinder 12 to vent volume 57 during the reciprocal movement of piston 14 and may be connected to a source of pressure and vacuum for driving shuttle piston 14.

An ancillary chamber 52 is provided in shuttle piston 14 so that even if the head of dispenser piston 26 is fully extended there is still a portion of head 26 which would be exposed to the pressurized feed in reservoir 18 through chamber 52 to enable piston 24 to be driven to the left or retracted during the feed cycle.

Figure 2:
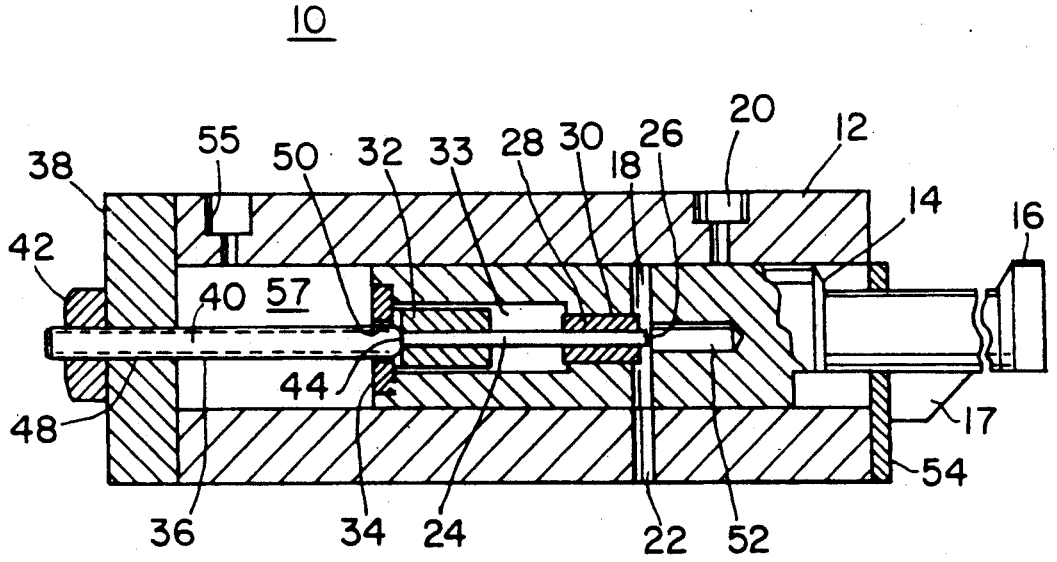
FIG. 2 is a view similar to FIG. 1 of the pump in the dispensing cycle.

This can be seen more readily in the dispensing cycle, as shown in FIG. 2, where head 26 is protruding into reservoir 18 and the additional volume provided by chamber 52 is operating advantageously to impose the feed pressure. Also shown more clearly in FIG. 2 is the condition of shuttle piston 14 during the dispensing cycle. There the end 46 of rod 40 of actuator 36 has been received in bore 50 of limit plate 34, where it bumps up against the left end 44 of reciprocating piston 24 and drives it to the right relative to shuttle piston 14, which has moved to the left, thereby causing the head 26 of dispensing piston 24 to enter reservoir 18 and pressurize the feed fluid. Since reservoir 18 is no longer aligned with inlet 20 but is aligned with outlet 22, the precise and repeatable minute amount of feed is dispensed through outlet port 22. Piston 14 is limited in its rightward motion in the feed cycle by limit plate 54, and in its leftward motion in the dispensing cycle by a stop shoulder 17 on handle 16.

Piston 14 has a diameter of 0.500 mil and a length of 0.3 inch and has a slip fit 0.0500 inch engagement with cylinder 12. Metering or dispensing piston 24 has a length of 0.500 inches, a diameter of 0.00010, and has a 0.0500 slip fit with bearing 28. Cross bore reservoir 18 is 0.5 inch long, 0.05 inch in diameter, and contains a volume of 0.001 cubic inch. Ancillary chamber 52 is approximately 0.1 inch in diameter, 0.5 inch long and contains a volume of 0.004 cubic inch.

Figure 3:
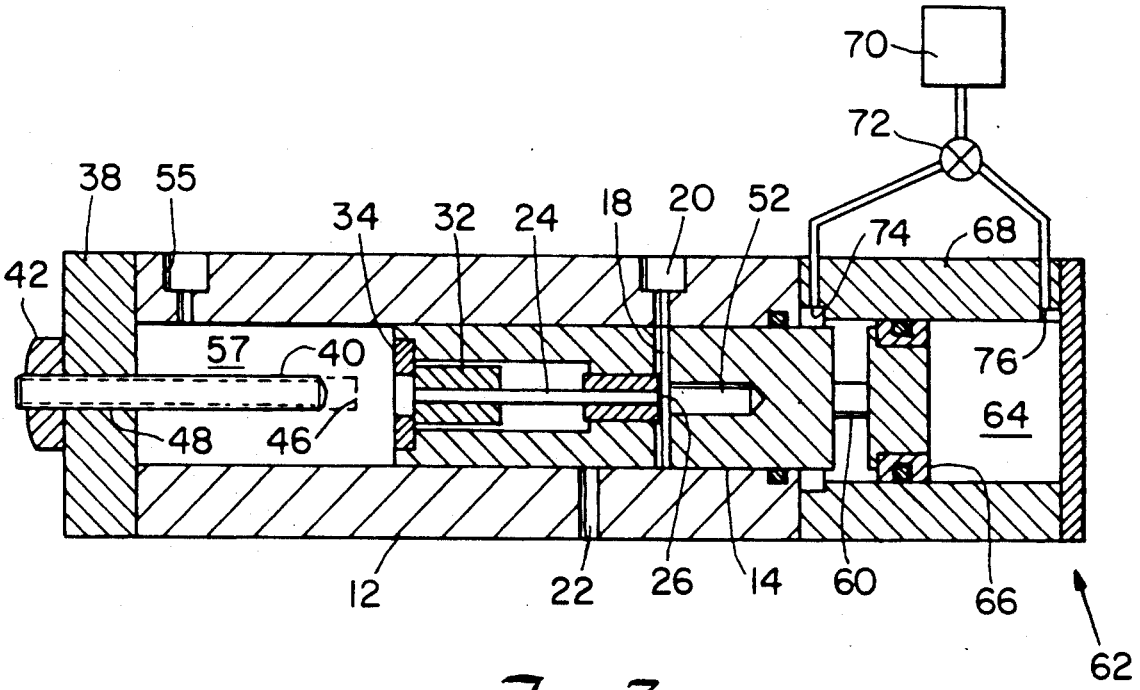
FIG. 3 is a view similar to FIG. 1 showing a pneumatic drive for the shuttle piston.

Although in FIGS. 1 and 2 piston 14 is shown as capable of being driven to and fro by handle 16, this is not a necessary limitation of the invention. Any suitable means including all available automatic devices may be used to operate shuttle piston 14. For example, in FIG. 3, handle 16 has been replaced by a simple connecting rod 60 which acts as a means for operating piston 14. That rod 60 is driven by a pneumatic solenoid 62, which includes a piston 64 fixed to rod 60 and slidably received in bore 66 within housing 68. A source of pneumatic pressure 70 provides pneumatic pressure through valve 72, first to inlet 74 which drives piston 64 to the right, and shuttle piston 14 to the feed cycle, and second inlet 76, which introduces pneumatic pressure to drive piston 64 to the left and shuttle piston 14 to the dispensing cycle.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A positive displacement shuttle pump comprising:
a cylinder with axially displaced and mutually isolated inlet and outlet ports;
a shuttle piston having a reservoir for accepting pressurized feed from the inlet port in the feed cycle and for dispensing feed to the outlet port in the dispensing cycle;
a displacement piston extending longitudinally in said shuttle piston and communicating with said reservoir;
an actuator for extending said displacement piston into said reservoir to pressurize the feed and urge the feed through said outlet port during the dispensing cycle, said displacement piston being responsive to said pressurized feed in said reservoir for retracting during the feed cycle; and
means for driving said shuttle piston through said feed and dispensing cycles.

2. The positive displacement shuttle pump of claim 1 in which said cylinder and said shuttle piston are of circular cross section.

3. The positive displacement shuttle pump of claim 1 in which said ports are on opposite sides of said cylinder.

4. The positive displacement shuttle pump of claim 1 in which said reservoir includes a cross-bore in said shuttle piston.

5. The positive displacement shuttle pump of claim 1 in which said displacement piston is coaxial with said shuttle piston.

6. The positive displacement shuttle pump of claim 2 in which said displacement piston is coaxial with said shuttle piston.

7. The positive displacement shuttle pump of claim 2 in which said displacement piston includes stop means to limit the retraction of said displacement piston in the feed cycle.

8. The positive displacement shuttle pump of claim 1 in which said reservoir includes a chamber proximate said displacement piston for exposing said displacement piston to feed pressure during said feed cycle to retract said displacement piston.

9. The positive displacement shuttle pump of claim 1 in which said actuator includes adjustment means for setting the amount of feed dispensed by said displacement piston.

10. The positive displacement shuttle pump of claim 1 in which said means for driving includes a connecting rod.

11. The positive displacement shuttle pump of claim 1 in which said means for driving includes a handle.

* * * * *